United States Patent [19]

Watanabe et al.

[11] Patent Number: 4,570,587

[45] Date of Patent: Feb. 18, 1986

[54] INTERNAL COMBUSTION ENGINE

[75] Inventors: Yoshimi Watanabe; Yukio Tada; Takanori Suzuki; Hitoshi Suzuki, all of Saitama, Japan

[73] Assignee: Honda Giken Kogyo Kabushiki Kaisha, Tokyo, Japan

[21] Appl. No.: 594,162

[22] Filed: Mar. 28, 1984

[30] Foreign Application Priority Data

Mar. 29, 1983 [JP] Japan ..... 58-54286
Mar. 29, 1983 [JP] Japan ..... 58-46077[U]
Mar. 29, 1983 [JP] Japan ..... 58-46080[U]

[51] Int. Cl.[4] ..... F01B 31/00

[52] U.S. Cl. ..... 123/193 P; 92/128; 123/195 HC; 123/195 C; 123/196 W; 123/DIG. 6

[58] Field of Search ..... 123/195 R, 195 HC, 195 C, 123/193 P, 198 E, 196 W, DIG. 6; 92/128

[56] References Cited

U.S. PATENT DOCUMENTS 1,890,914 12/1932 Parsons ..... 92/128
3,596,571 8/1971 Hill ..... 123/193 P
4,406,590 9/1983 Kessler ..... 92/128

FOREIGN PATENT DOCUMENTS 634936 3/1928 France ..... 123/195 R

*Primary Examiner*—Craig R. Feinberg
*Attorney, Agent, or Firm*—Armstrong, Nikaido, Marmelstein & Kubovcik

[57] ABSTRACT

An internal combustion engine includes a crank shaft having a crank web, a crank pin on one end of the crank web, and a weight on an opposite end of the crank web, a crank case supporting the crank shaft therein, a cylinder, a piston reciprocally fitted in the cylinder, a rod coupled to the piston by a piston pin and connecting the piston to the crank pin for reciprocally moving the piston in the cylinder, the crank case having an opening and extending obliquely to axes of the crank shaft and the cylinder. The cylinder has an end corresponding to a bottom dead center of the piston and having a first recess opening toward the opening, the first recess being of a size allowing the piston pin to pass therethrough when the piston is in the bottom dead center. The weight on the crank web has on one side a second recess of a shape defining with the end of the cylinder a space allowing the piston as disconnected from the rod to pass therethrough.

2 Claims, 13 Drawing Figures

INTERNAL COMBUSTION ENGINE

BACKGROUND OF THE INVENTION

1. Field of the Invention:

The present invention relates to an internal combustion engine, and more particularly to an improved internal combustion engine having a substantially horizontal cylinder and a substantially vertical crank shaft.

2. Description of the Prior Art:

There are known internal combustion engines having a substantially horizontal cylinder and a substantially vertical crank shaft. One such internal combustion engine is disclosed in Japanese Patent Laid-Open Publication No. 54-27615 published Mar. 1, 1979. According to the disclosed internal combustion engine, a crank case can be divided into parts along a plane lying obliquely to the direction in which a piston can reciprocate and the axis of a crank shaft, so that crank shaft bearings can be precision-machined and the overall engine can easily be assembled.

When disassembling the prior internal combustion engine for servicing or repair, however, the piston cannot be removed unless a crank pin is pulled out to separate the crank shaft from a connecting rod and take out the crank shaft in advance. The present invention has been made in an effort to eliminate such an inconvenient disassembling procedure.

SUMMARY OF THE INVENTION

According to the present invention, there is provided an internal combustion engine comprising a crank shaft having a crank web, a crank pin on one end of the crank web, and a weight on an opposite end of the crank web, a crank case supporting the crank shaft therein, a cylinder, a piston reciprocally fitted in the cylinder, a rod coupled to the piston by a piston pin and connecting the piston to the crank pin for reciprocally moving the piston in the cylinder, the crank case having an opening and extending obliquely to axes of the crank shaft and the cylinder, the cylinder having an end corresponding to a bottom dead center of the piston and having a first recess opening toward the opening, the first recess being of a size allowing the piston pin to pass therethrough when the piston is in the bottom dead center, and the crank web being disposed on an axial end of the crank shaft, the weight having a second recess on one side thereof, the second recess being of a shape defining with the end of the cylinder a space allowing the piston as disconnected from the rod to pass therethrough.

Therefore, it is a primary object of the present invention to provide an internal combustion engine in which a piston and a connecting rod can be removed from an engine body without having to take out a crank shaft previously when disassembling the engine.

Another object of the present invention is to provide an internal combustion engine having an arrangement of engine components suitable for enabling a crank shaft to directly drive an engine-operated machine, driving a cam shaft meshing with the crank shaft to control intake and exhaust valves of the engine, and picking up drive power through an output shaft meshing with the crank shaft.

Still another object of the present invention is to provide an internal combustion engine having a simple structure for achieving high-speed rotation of a governor which controls the throttle valve of a carburetor.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
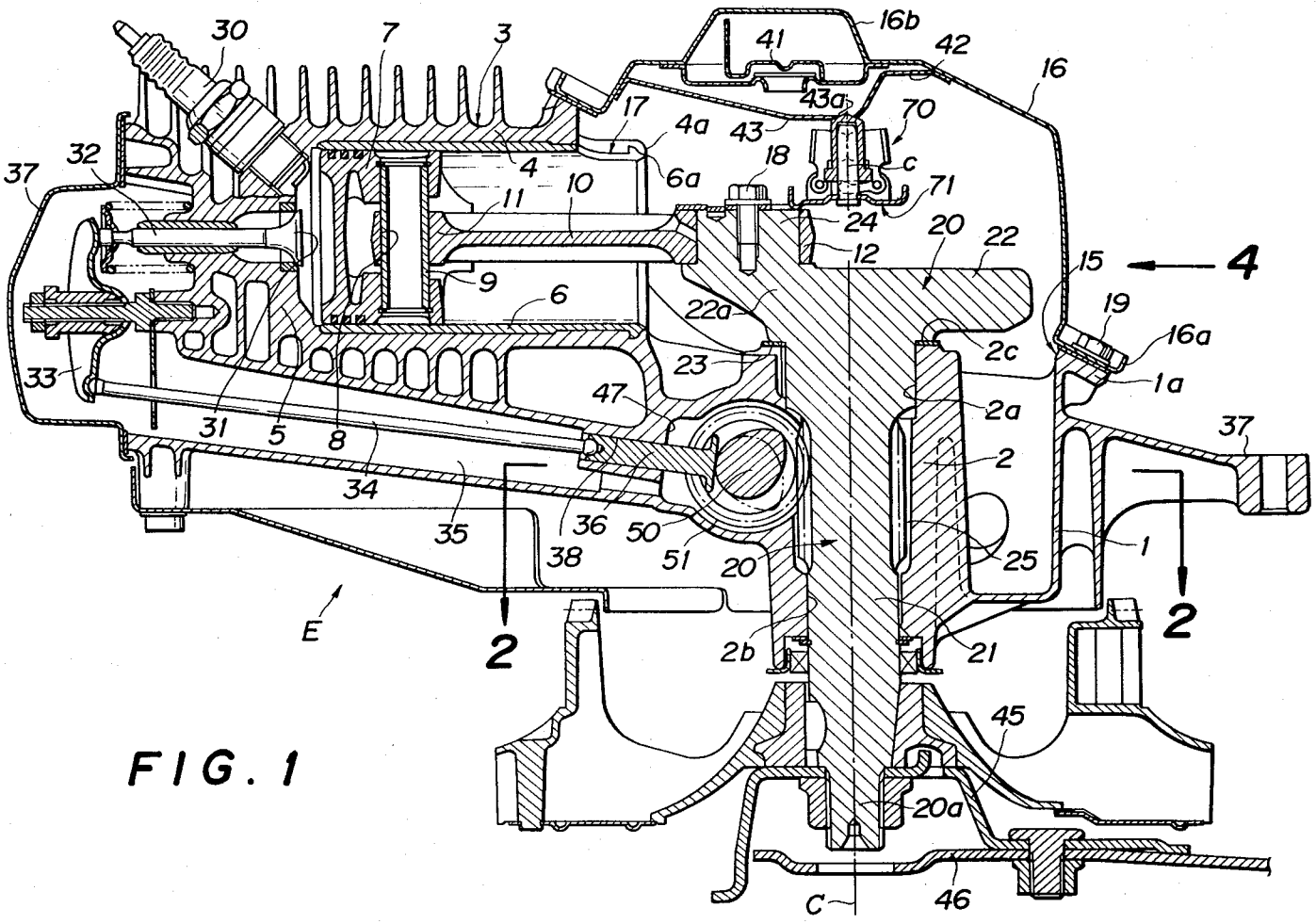
FIG. 1 is a vertical cross-sectional view of an internal combustion engine according to the present invention.

As shown in FIG. 1, an internal combustion engine E has a vertical crank shaft 20 supported in a cantilevered fashion, a horizontal cylinder 3, a vertical crank case 1 housing the crank shaft 20, a cylinder block 4 and a cylinder head 5 which jointly define the horizontal cylinder 3, the crank case 1, the cylinder block 4 and the cylinder head 5 comprising an integral casting.

The crank case 1 has an upper opening 15 defined by an edge extending obliquely to the axes of the crank shaft 20 and the cylinder 3 and downwardly from an end of the cylinder 3 which is remote from the cylinder head 5. The upper opening 15 is covered with a removable cover 16 made of a pressed steel sheet. The cover 16 has an upper bulging sheet portion **16*a* accommodating a breather 41 therein. A downwardly bulging sheet 42 underlies the upper sheet portion 16*a* and serves as a baffle for the breather 41. The downwardly bulging sheet 42 has a lower surface doubling as an oil guide and includes a lowest portion 43 positioned in substantial alignment with a central axis C of the crank shaft 20**.

A piston 7 is slidably fitted in the cylinder 3. An ignition plug 30 is mounted on the cylinder head 5 and extends obliquely downwardly toward the cylinder 3. The cylinder head 5 also supports laterally spaced intake and exhaust valves 31 (one shown in FIG. 1) in a central portion thereof. The valves 31 have valve stems 32 held in engagement with ends of respective rocker arms 33, the other ends of which engage distal ends of push rods 34, respectively. The push rods 34 slidably extend through a push rod passage 35 defined below the cylinder 3 in lower portions of the cylinder block 4 and the cylinder head 5. A cover 37 in the form of a pressed steel sheet is mounted on the cylinder head 5 in covering relation to the rocker arms 33.

The crank shaft 20 has a crank web 22 on an upper end thereof, a crank pin 24 on an upper surface of one end of the crank web 22, the crank pin 24 being positioned eccentrically with respect to the central axis of the crank shaft 20, and weights 22*b*, 22*c* on an opposite end of the crank web 22. The crank shaft 20 extends downwardly and is supported in a cantilevered manner.

The crank case 1 has a vertical bearing 2 on the bottom thereof having axially spaced bearing portions 2*a*, 2*b* by which the crank shaft 20 is rotatably supported. The vertical bearing 2 has an upper end 2*c* serving as a thrust bearing for supporting the crank shaft 20 in its axial direction.

A cylinder sleeve 6 is fitted in the horizontal cylinder 3. The piston 7 is slidably fitted in the cylinder sleeve 6 and connected to a smaller-diameter end 11 of a horizontal connecting rod 10 by a piston pin 9 extending through a pin hole 8 in the smaller-diameter end 11. The connecting rod 10 has a larger-diameter end 12 fitted over the crank pin 24 of the crank shaft 20. The larger-diameter end 12 is prevented from being axially detached from the crank pin 24 by a holder plate 71 fastened by a bolt 18 to an end surface of the crank pin 24. The plate 71 doubles as a base of a governor 70.

The crank shaft 20 has a lower end portion including an output end 20*a* projecting downwardly of the crank case 1. A cutter blade 46 or other desired engine-operated member is detachably fastened to the output end 20*a* by a holder 45.

The crank shaft 20 has gear teeth 25 of a certain axial length around an intermediate outer peripheral surface. The bearing 2 has a recess 47 in its side closer to the cylinder 3 with the gear teeth 25 being partially exposed in the recess 47. A horizontal cam shaft 50 extends through the recess 47 in a direction normal to the crank shaft 20 and has gear teeth 51 on an intermediate peripheral surface thereof which are held in mesh with the gear teeth 25.

Figure 2:
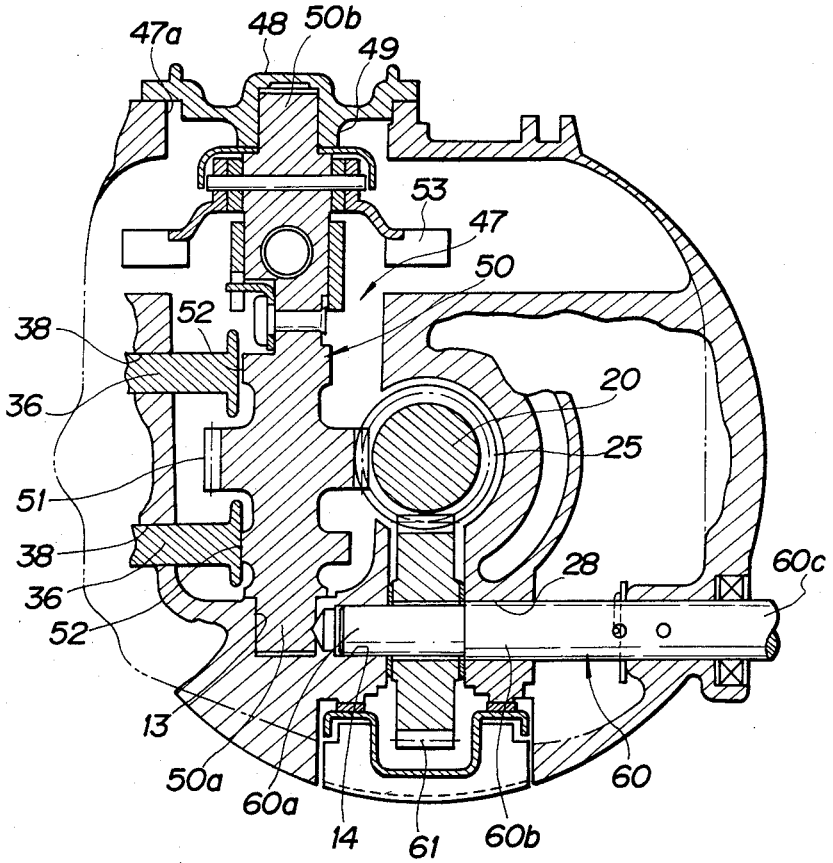
FIG. 2 is a cross-sectional view taken along line 2—2 of FIG. 1.

As clearly illustrated in FIG. 2, the cam shaft 50 has cams 52, 52 spaced axially in axially sandwiching relation to the gear teeth 51. The cam shaft 50 has an end 50*a* journalled in a bearing recess 13 defined in the crank case 1. The cam shaft 50 supports an oil slinger 53 thereon in the vicinity of an opposite end 50*b* for scraping up oil. The end 50*b* of the cam shaft 50 is rotatably journalled in a bearing 49 of a cap 48 covering a lateral opening 47*a* of a recess 47 in the bearing 2. The cams 52, 52 on the cam shaft 50 are held against lifters 36 slidably supported in guide holes 38, respectively, defined in an end portion of the push rod passage 35.

As illustrated in FIG. 1, the push rods 34 have ends joined to the lifters 36 and opposite ends engaging ends of the rocker arms 33, the other ends of which are held in engagement with outer ends of the stems 32 of the intake and exhaust valves 31. These components jointly constitute a valve operating mechanism.

Turning back to FIG. 2, an output shaft 60 is disposed in substantial alignment with the circumference of the gear teeth 25 and angularly spaced from the cam shaft 50. More specifically, the output shaft 60 is angularly spaced about 90° from the cam shaft 50 and lies in the same plane as that in which the cam shaft 50 lies, so that the shafts 60, 50 have axes extending perpendicularly to each other. The output shaft 60 has an end 60*a* journalled in a bearing recess 14 defined in the crank case 1 adjacent to the bearing recess 13 in perpendicular relation thereto. A power pickup gear 61 is fixedly mounted on the output shaft 60 closely to the end 60*a* and held in mesh with the gear teeth 25 on the crank shaft 20 in 90°-spaced relation to the gear teeth 51 on the cam shaft 50. The output shaft 60 has an intermediate portion 60*b* journalled in a bearing boss 28 disposed in the vicinity of the bearing 2 of the crank case 1. The output shaft 60 also has an end 60*c* remote from the end 60*a* and projecting out of the crank case 1 for transmitting engine power through a clutch mechanism (not shown) to wheels (not shown).

Therefore, the cutter blade or engine-operated member 46 mounted on the output end 20*a* of the crank shaft 20 is rotated in response to rotation of the crank shaft 20 for performing a desired operation. Rotation of the crank shaft 20 causes the gear teeth 25, 51 to drive the cam shaft 50 for opening and closing the valves 31. Rotative power from the crank shaft 20 also flows to the output shaft 60 through the gear teeth 25 and the gear 61 meshing therewith in angularly spaced relation to the gear teeth 51. The output shaft 60 then causes the clutch mechanism to drive the wheels to move the entire machine.

The governor 70 positioned in a space above the crank web 22 on the upper end of the crank shaft 20 serves to control the throttle valve in a carburetor.

Figure 3:
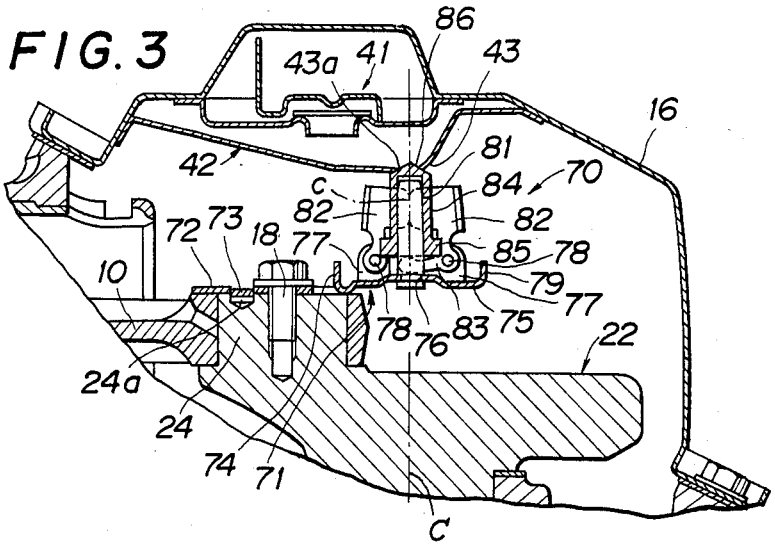
FIG. 3 is a fragmentary cross-sectional view of a governor in the internal combustion engine of FIG. 1.

As shown in FIG. 3, the holder plate 71 of the governor 70 has a base portion 72 fastened by the bolt 18 to the upper end surface of the crank pin 24. The base portion 72 of the holder plate 71 has two slit pieces 73 (only one shown) engaging respectively in two recesses 24*a* (only one shown) defined in the upper end surface of the crank pin 24 to position the base portion 72 with respect to the crank pin 24. As described above, the base portion 72 serves as a stopper plate for preventing the connecting rod 10 from being detached from the crank pin 24.

The holder plate 71 also has an integral extension 75 extending from the base portion 72 across the central axis C of the crank shaft 20 in overhanging relation to the crank web 22. The extension 75 has a pin hole 76 aligned with the central axis C of the crank shaft 20. A center pin 81 is fitted in the pin hole 76 and disposed vertically on the extension 75 with its central axis c aligned with the central axis C.

The extension 75 has a pair of diametrically opposite slit weight brackets 77, 77 erected one on each side of the center pin 81. Governor weights 82, 82 are pivotally supported on the weight brackets 77, 77, respectively, by means of pivot pins 78, 78. A cap-shaped governor slider 84 is slidably mounted on the center pin 81 in covering relation to an upper portion of the center pin 81. The governor slider 84 has a lower flange 85 having a lower end surface against which pusher arms 83, 83 integral with the governor weights 82, 82 are held in diametrically opposite relation to each other.

Figure 4:
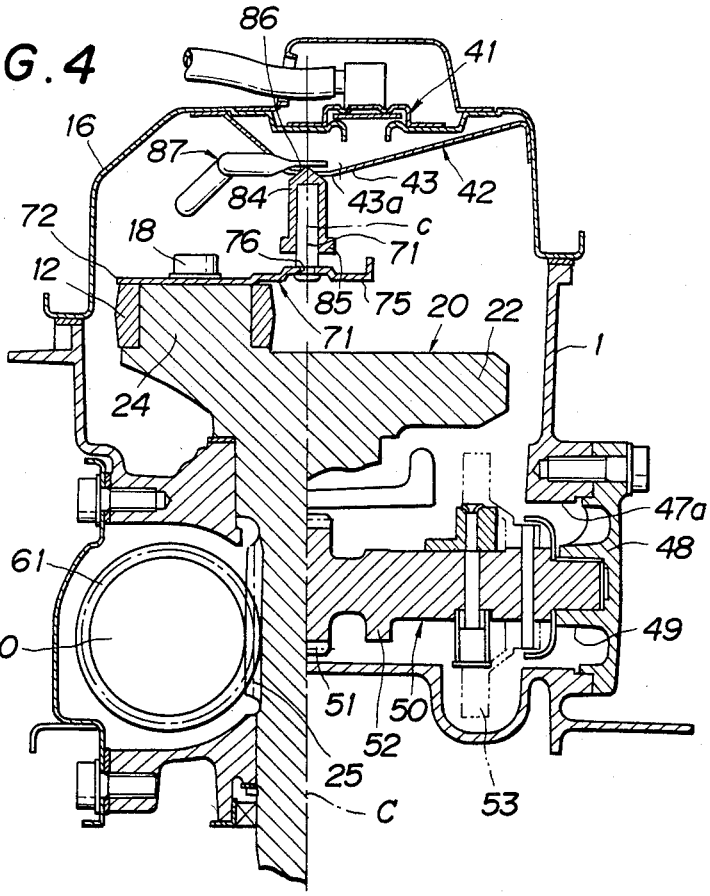
FIG. 4 is an enlarged fragmentary cross-sectional view as seen in the direction of the arrow 4, the view showing different sections of engine components.

As illustrated in FIG. 4, the governor slider 84 has a pusher end 86 positioned in a guide port 43*a* defined in the lowermost portion 43 of the bulging sheet 42. The pusher end 86 is held against an end of a link mechanism 87 operatively coupled to the throttle valve of the carburetor. The extension 75 of the holder plate 71 has an upstanding portion 79 at a distal end thereof. The portion of the holder plate 71 between the base portion 72 and the extension 75 is slit to provide an upstanding portion 74. These upstanding portions 74, 79 serve to give the extension 75 an increased degree of rigidity.

Referring back to FIG. 1, the cover 16 covering the opening 15 in the crank case 1 has peripheral flanges 16*a* fastened by bolts 19 to attachment bosses 1*a* disposed peripherally around the opening 15. The cover 16 can therefore be detached by unfastening the bolts 19. The opening 15 is of a size that is necessary and sufficient for introducing the crank shaft 20 therethrough into the crank case 1. An upper end 4*a* of the cylinder block 4 facing the opening 15 and an upper end 6*a* of the cylinder sleeve 6 facing the opening 15 have a semicircular recess 17 defined by an edge which is arcuately curved upwardly away from the axis of the cylinder 3. The recess 17 is of a size greater than the diameters of the piston pin 9 and the smaller-diameter end 11 of the connecting rod 10.

Figure 5:
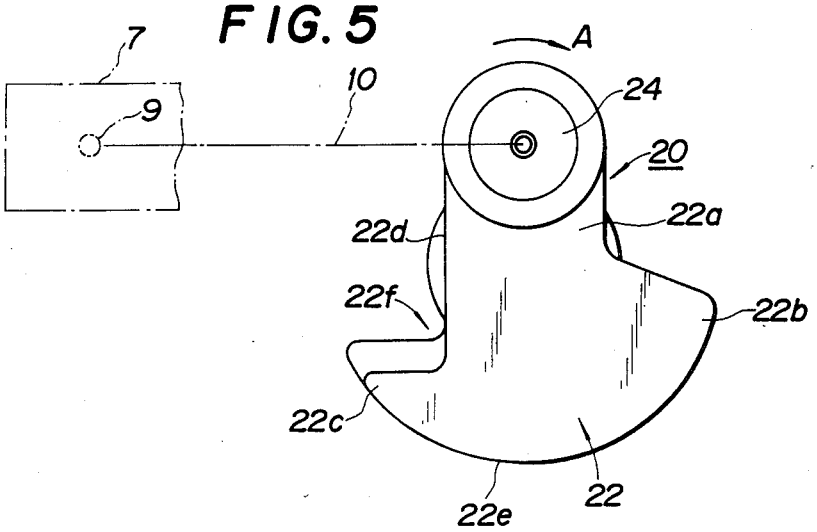
FIG. 5 is a plan view of a crank shaft and a crank web.

As shown in FIG. 5, the crank web 22 of the crank shaft 20 is composed of a base portion 22*a* on which the crank pin 24 is formed, the righthand half weight 22*b* projecting rightward, and the lefthand half weight 22*c* projecting leftward. The base portion 22*a* has a righthand side edge 22*g* leading to the righthand half weight 22*b* and a lefthand side edge 22*d* leading to the lefthand half weight 22*c*, the lefthand side edge 22*d* being longer than the righthand side edge 22*g*. The lefthand half weight 22*c* has an edge contiguous to and extending perpendicularly from the lefthand side edge 22*d* and blending into an arcuate front edge 22*e*. The lefthand side edge 22*d* and the edge of the lefthand half weight 22*c* contiguous thereto jointly define a recess 22*f* (shown on the lefthand side). Thus, the crank web 22 is unbalanced in weight and asymmetrical in shape. In FIG. 5, the connecting rod 10, the piston 7, and the piston pin 9 are schematically shown by the imaginary lines. The direction of rotation of the crank shaft 20 is indicated by the arrow A with the recess 22*f* positioned on the leading side at the time the crank web 22 is rotated.

The internal combustion engine E having the recess 17 in the end of the cylinder 3 and the recess 22*f* in one side of the crank web 22 will be disassembled and assembled as follows:

In FIG. 1, the cover 16 is detached by unfastening the bolts 19 to expose the opening 15 in the crank case 1. Then, the bolt 18 is removed from the upper end surface of the crank pin 24 to detach the holder plate 71 supporting the governor weights 82, 82. The larger-diameter end 12 of the connecting rod 10 can now be detached from the crank pin 24.

Figure 6:
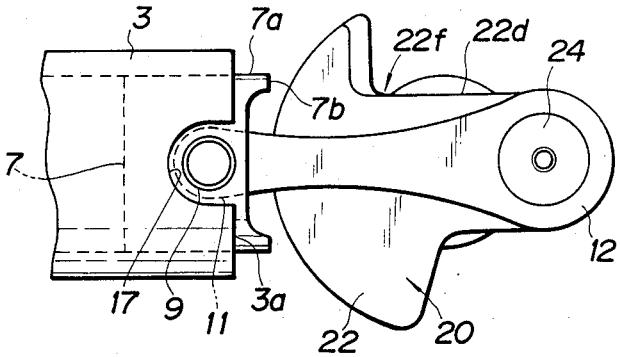
FIG. 6 is a plan view of a cylinder, a piston, and the crank web as they are positioned when the piston is in the bottom dead center.
Figure 7:
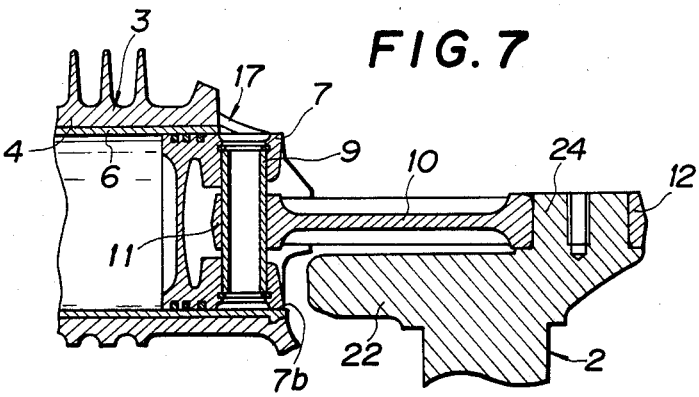
FIG. 7 is a fragmentary cross-sectional view of the components shown in FIG. 6.
Figure 8:
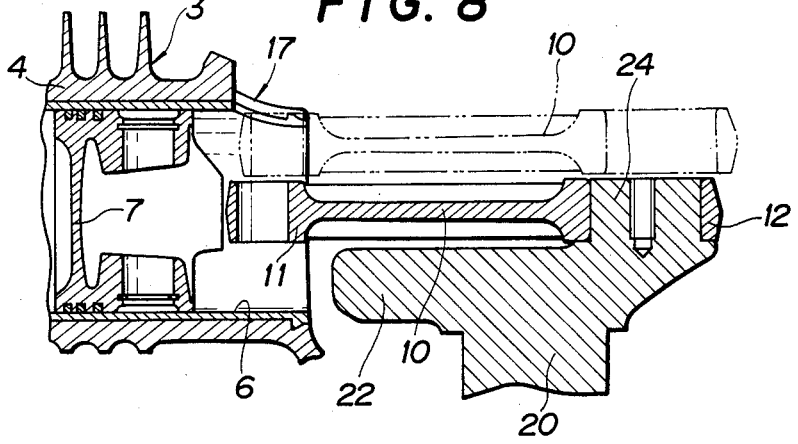
FIG. 8 is an enlarged fragmentary cross-sectional view similar to FIG. 7, showing the manner in which a connecting rod is removed.

The crank shaft 20 is thereafter rotated to bring the piston 7 to the bottom dead center as shown in FIGS. 6 and 7. The piston 7 is lowered in the cylinder 3 until a lower piston portion including a lower end 7*b* of a skirt 7*a* is exposed out of the end 3*a* of the cylinder 3, whereupon the piston pin 9 faces the recess 17 in the cylinder 3. The piston pin 9 is now pulled out. The smaller-diameter end 11 of the connecting rod 10 and the piston 7 can now freely be moved. Then, the piston 7 as separated from the connecting rod 10 is moved into the cylinder 7 to allow the smaller-diameter end 11 of the connecting rod 10 to face the recess 17. By lifting the connecting rod 10 along the axis of the crank pin 24, the larger-diameter end 12 is detached from the crank pin 24 as illustrated in FIG. 8.

Figure 9:
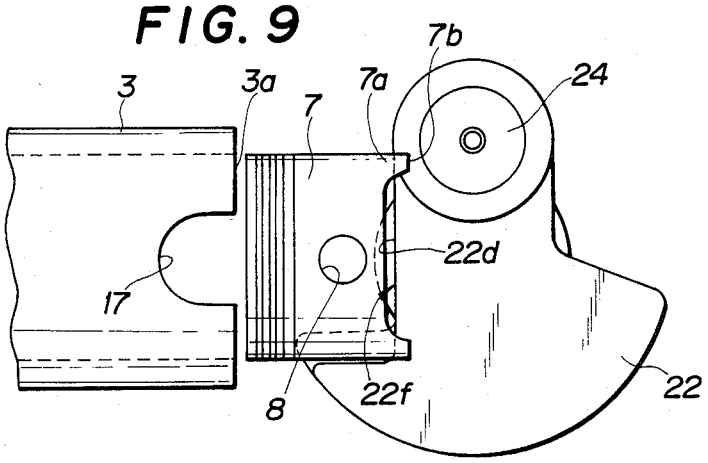
FIG. 9 is a plan view of the cylinder, the piston, and the crank web as they are positioned to allow the piston to be removed.
Figure 10:
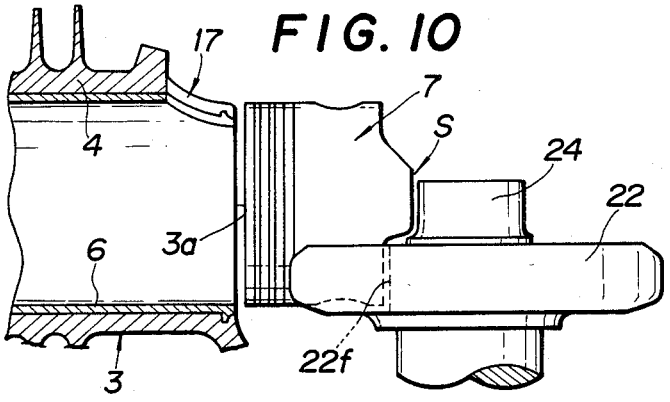
FIG. 10 is a partially sectional side elevational view of the components illustrated in FIG. 9.

Thereafter, the crank shaft 20 is turned from the above position counterclockwise through 90° in FIG. 6 to bring the recess 22*f* in the crank web 22 into confronting relation to the end 3*a* of the cylinder 3. At this time, there is a space S (FIG. 10) defined between the edge 22*d* of the recess 22*f* and the end 3*a* of the cylinder 3 and wide enough to take up the vertical dimension of the piston 7. Then, the piston 7 is axially pulled out of the cylinder 3 into the space S as shown in FIGS. 9 and 10. The piston 7 can be taken out of the crank case 1 through the opening 15 for repair such as replacement of the piston rings.

The piston 7 and the connecting rod 10 can be assembled and re-assembled in a procedure which is a reversal of the foregoing procedure. The piston 7 can be taken into or out of the crank case 1 with the crank shaft 20 remaining assembled in the crank case 1.

Figure 11:
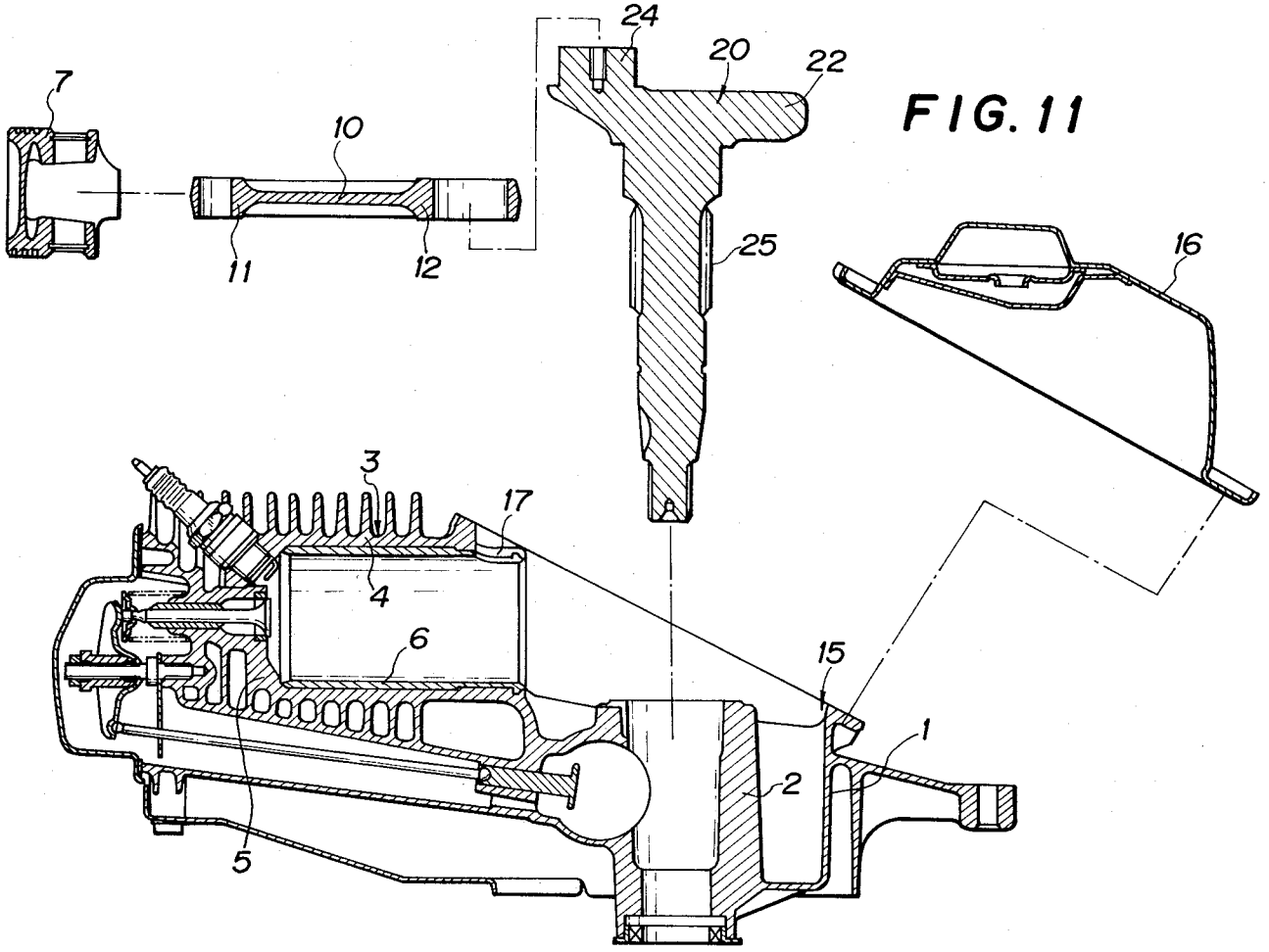
FIG. 11 is an exploded cross-sectional view of the internal combustion engine.

The crank shaft 20 can be removed by first pulling out the cam shaft 50 through the opening 47*a* larger in diameter than the gear teeth 51, and then pulling out the freed crank shaft 20 through the opening 15. Accordingly, the piston 7, the connecting rod 10, and the crank shaft 20 can all be removed out without having to disassemble the cylinder 3 and the crank case 1, as illustrated in FIG. 11.

Figure 12:
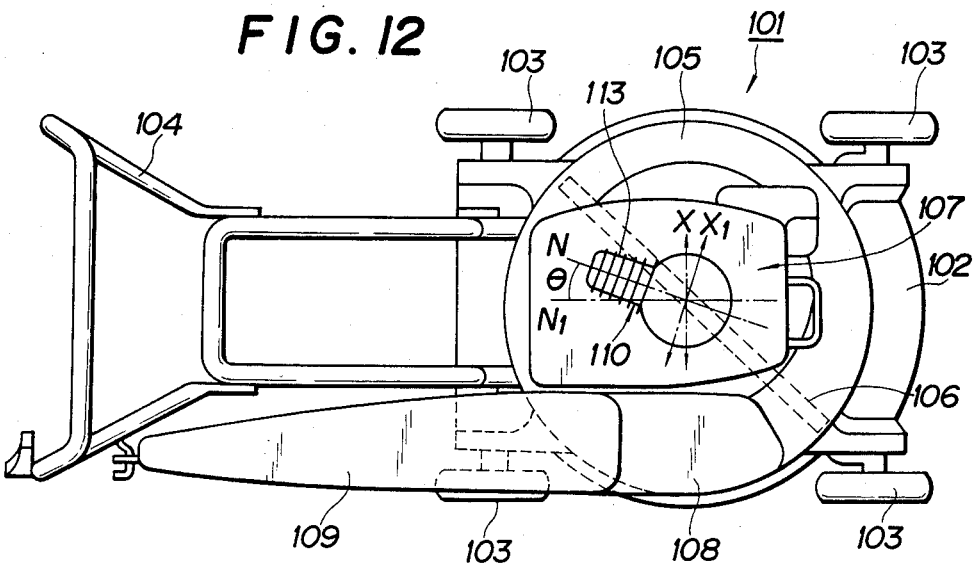
FIG. 12 is a plan view of a lawn mower on which the internal combustion engine of the present invention is mounted.
Figure 13:
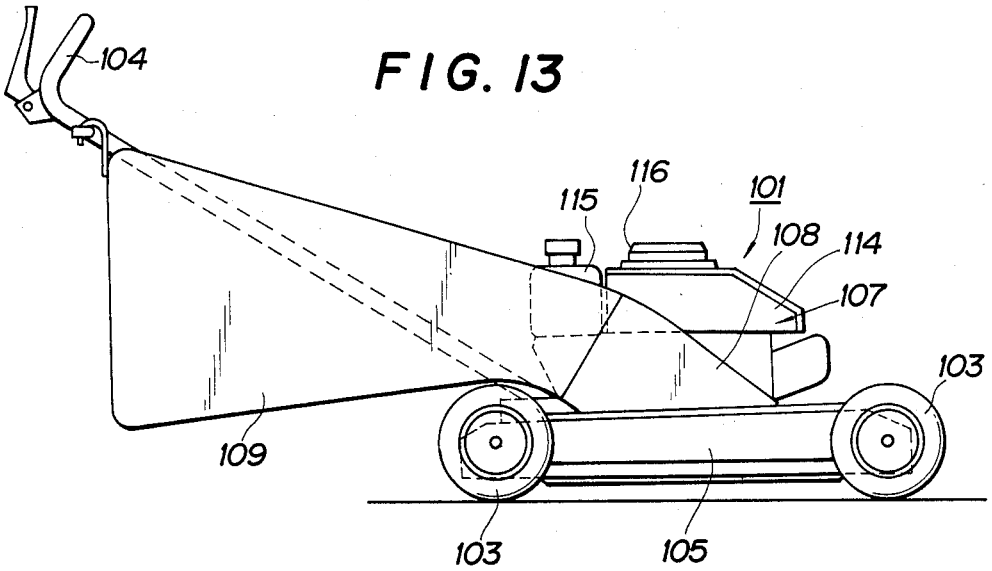
FIG. 13 is a side elevational view of the lawn mower shown in FIG. 12.

FIGS. 12 and 13 show a lawn mower as one example of an engine-operated machine on which the internal combustion engine according to the present invention is mounted.

The lawn mower, generally denoted by the reference numeral 101, has a machine body 102 having wheels 103 at its corners, a handle 104 exending rearward and upwardly from a rear end of the machine body 102, and a housing 105 which is circular when viewed in plan and disposed diametrically between the wheels 103. The housing 105 is open downwardly and houses a cutter blade 106 therein. A power unit 107 is mounted on the housing 105. A grass discharge chute 108 is mounted on the housing 105 on one side thereof and directed rearward and upwardly. The grass discharge chute 108 has an outlet coupled to an end of a grass collector bag 109 disposed alongside of the handle 104 and having an opposite end hooked on a side pin of the handle 104. Designated at 114 is a cover which covers the power unit 107, 115 a fuel tank, and 116 an cooling air inlet.

The power unit 107 is composed of an internal combustion engine 110 according to the present invention, the engine 110 including a cylinder 113 having an axis N inclined through an angle of $\theta$° from a longitudinal axis $N_1$ of the machine body 102 away from the grass discharge chute 108.

Usually, the crank shaft of a single-cylinder engine is balanced such that the engine will produce principal vibrations due to rotation of the crank shaft in a direction normal to the axis of the cylinder. Where the axis N of the cylinder is inclined with respect to the central longitudinal axis $N_1$ of the machine body as with the engine installation of the lawn mower 101, the principal vibrations of the engine are produced in the direction of the arrow $X_1$ shown in FIG. 12. Such engine vibrations contain components tending to vibrate the handle in the longitudinal direction of the machine body, thus adversely affecting control of the machine body. With the engine according to the present invention, however, the crank web 22 of the crank shaft is asymmetrical in a horizontal plane as described with reference to FIG. 5. Such an arrangement causes the engine to produce principal vibrations in the transverse direction of the arrow X in FIG. 12 while allowing the axis N of the cylinder 113 to be inclined to the longitudinal axis $N_1$, thereby reducing longitudinal vibratory forces transmitted to the handle 104 to as small a level as possible.

The internal combustion engine according to the present invention can be installed on other engine-operated machines than the lawn mower. While the internal combustion engine with the vertical crank shaft has been shown and described, the present invention is equally applicable to an internal combustion engine having a horizontal crank shaft.

The embodiment of the present invention has the following advantages:

1. The piston pin and the piston can easily be inserted and pulled out without having to remove the crank shaft from the crank case, with the result that the engine can be maintained or serviced and assembled with utmost ease.
2. The engine construction is simple and the number of engine components is small as the output shaft can be driven by the gear teeth on the crank shaft for driving the cam shaft.
3. Since the output shaft lies in the same plane as that in which the cam shaft lies, the inner end of the output shaft can be supported by the wall portion which supports the cam shaft, and hence the opposite ends of the output shaft is supported by a simple structure.
4. The crank case or the engine is rendered compact because the output shaft extends perpendicularly to the cam shaft.
5. The governor has a central axis aligned with the central axis of the crank shaft and is disposed over the end surface of the crank shaft. This construction allows the governor to rotate at the same high speed as that of rotation of the crank shaft. The governor can achieve higher performance through the simple arrangement.

Although there has been described what is at present considered to be the preferred embodiment of the present invention, it will be understood that the invention may be embodied in other specific forms without departing from the spirit or essential characteristics thereof. The present embodiment is therefore to be considered in all aspects as illustrative, and not restrictive. The scope of the invention is indicated by the appended claims rather than by the foregoing description.

What is claimed is:

1. A method of disassembling and assembling an internal combustion engine which includes a crank shaft having a crank web, a crank pin on one end of said crank web, and a weight on an opposite end of said crank web;

a crank case supporting said crank shaft therein;

a cylinder;

a piston reciprocally fitted in said cylinder;

a rod coupled to said piston by a piston pin and connecting said piston to said crank pin for reciprocally moving said piston in said cylinder;

said crank case having an opening extending obliquely to axes of said crank shaft and said cylinder;

said cylinder having an end corresponding to a bottom dead center of said piston and having a first recess opening toward said opening, said first recess being of a size allowing said piston pin to pass therethrough when said piston is in said bottom dead center; and said crank web being disposed on an axial end of said crank shaft, said weight having a second recess on one side thereof exposing adjoining back and side inwardly spaced surfaces of said weight, said second recess being of a shape defining with said end of said cylinder a space allowing said piston as disconnected from said rod to pass therethrough, the method comprising the steps of:

(a) exposing said opening in said crank case;

(b) positioning said piston in said bottom dead center in said cylinder via movement of said crank shaft to cause said piston pin and a pin hole therefor in said rod to face said first recess;

(c) passing said piston pin through said pin hole;

(d) bringing said second recess into confronting relation to said end of said cylinder to define said space therebetween via movement of said crank shaft such that said weight extends normal to said piston; and (e) passing said piston through said space.

2. A method according to claim 1, further including the steps of causing an end of said rod closer to said piston to face said first recess, and passing said end of said rod through said first recess.

* * * * *